US009327807B1

(12) United States Patent
Masson et al.

(10) Patent No.: US 9,327,807 B1
(45) Date of Patent: May 3, 2016

(54) TRANSPARENT AND BUOYANT AQUATIC RECREATION BOARD

(76) Inventors: Marc Maurice Masson, Orlando, FL (US); Joan Evelyn Masson, Orlandp, FL (US)

( * ) Notice: Subject to any disclaimer, the term of this patent is extended or adjusted under 35 U.S.C. 154(b) by 337 days.

(21) Appl. No.: 13/611,373

(22) Filed: Sep. 12, 2012

Related U.S. Application Data

(60) Provisional application No. 61/573,896, filed on Sep. 14, 2011.

(51) Int. Cl.
*B63B 35/79* (2006.01)

(52) U.S. Cl.
CPC ..... *B63B 35/79* (2013.01); *B63B 35/7906* (2013.01); *B63B 35/7909* (2013.01); *B63B 35/7926* (2013.01)

(58) Field of Classification Search
CPC B63B 35/79; B63B 35/7906; B63B 35/7909; B63B 35/7913; B63B 35/7916; B63B 35/792; B63B 35/7923; B63B 35/7926; B63B 35/793; B63B 2035/79; B63B 2035/7903; B63B 2035/818
USPC ..... 441/65–67, 74–79
See application file for complete search history.

(56) References Cited

U.S. PATENT DOCUMENTS

| | | | | | |
|---|---|---|---|---|---|
| D221,697 | S | * | 8/1971 | Nicholson | D21/809 |
| 4,209,867 | A | * | 7/1980 | Abrams, III | 441/74 |
| 4,840,592 | A | * | 6/1989 | Anderson | 441/135 |
| 4,925,417 | A | | 5/1990 | Warren | |
| D378,692 | S | * | 4/1997 | Lincoln | D21/769 |
| RE38,467 | E | * | 3/2004 | Lincoln | D21/769 |
| D503,206 | S | | 3/2005 | Debold | |
| 7,238,075 | B2 | * | 7/2007 | Brodsky | 441/80 |
| 7,316,597 | B2 | | 1/2008 | Skedeleski | |
| 7,507,132 | B2 | | 3/2009 | Grune et al. | |
| 7,811,144 | B2 | * | 10/2010 | Cavanaugh | 441/80 |
| 2002/0115366 | A1 | | 8/2002 | Harkrider | |
| 2005/0064774 | A1 | * | 3/2005 | Grune et al. | 441/74 |

(Continued)

FOREIGN PATENT DOCUMENTS

| | | | | | |
|---|---|---|---|---|---|
| GB | 2165186 | A | * | 4/1986 | B63C 11/48 |
| GB | 2457687 | A | * | 8/2009 | B63B 35/79 |

OTHER PUBLICATIONS

"Oareye Surfboards: Clear Hollow Technology"—The Swaylocks forum, posted on May 2011.*

(Continued)

*Primary Examiner* — Ajay Vasudeva
(74) *Attorney, Agent, or Firm* — Terry M. Sanks, Esq.; Beusse Wolter Sanks & Maire, PLLC

(57) ABSTRACT

A transparent and buoyant aquatic recreation board is provided. The board includes an elongated buoyant body having front and rear ends and upper and lower surfaces extending between the front and rear ends. The body is constructed of a substantially transparent material. A support frame is disposed within the body and provides support to the body against collapsing. The support frame has a main spar extending between the front and the rear ends of the body, a first plurality of transverse spars extending laterally outward from a first longitudinal side of the main spar at spaced intervals, and a second plurality of transverse spars extending laterally outward from a second longitudinal side of the main spar at spaced intervals.

4 Claims, 4 Drawing Sheets

(56) References Cited

U.S. PATENT DOCUMENTS

2005/0247248 A1 11/2005 Caplan et al.
2010/0048071 A1* 2/2010 Nascimento ..... 441/74

OTHER PUBLICATIONS

"Oareye Transparent Surfboards"—The Shaperoom Surfboard Design forum, posted on Mar. 2011.*

* cited by examiner

TRANSPARENT AND BUOYANT AQUATIC RECREATION BOARD

CROSS-REFERENCE TO RELATED APPLICATIONS

This application claims the benefit of U.S. Provisional Application No. 61/573,896 filed Sep. 14, 2011, the entirety of which is incorporated herein by reference.

FIELD OF THE INVENTION

The present invention relates generally to recreation water boards utilized to propel a user across the surface of a body of water and more particularly, relating to a transparent recreation water board of a construction providing a user with an underwater view.

BACKGROUND OF THE INVENTION

There exist a number of recreation water boards that have a viewing window structure that permits a user to see-through the board for the purpose of underwater viewing. U.S. Pat. No. 4,925,417 describes a prone position paddle board having a window structure from through a section of the bow section of the board. In use, a person lying in the prone position upon the board is capable of looking through the window structure to view underwater. The common theme to these existing devices include the user lying in the prone position upon the board to facilitate both the user paddling the board forward and to permit the user to view through a window structure form through the board. While these existing devices meet their respective objective and requirements, they do not provide a user the ability to view through the board, and thus the underwater while standing on the board or without specifically looking through a localized window formed through the board while in the prone position.

U.S. Pat. No. 7,507,132 describes a transparent surfboard that is constructed entirely of a transparent foam material with the intended purpose of providing a user an increased visibility to detect nearby sharks. A drawback to this device is found that there is no support structure to prevent the device from breaking due to opposing loading forces applied to the board during use. It is generally known that surfboards, body boards and wake boards constructed entirely of a foam material are unable to withstand, at any great length, continuous use without failing.

Accordingly, there is a need for a recreation water board of a transparent construction that permits a user to see through the board and view the underwater from non-prone positions, such as, for example a standing position, and which has a structural integrity that resists board failure with continued use.

SUMMARY OF THE INVENTION

The embodiments of the present invention addresses this need by providing a recreation water board, and particularly, a standup paddle board having a transparent construction and a support frame structure which provides structural integrity to the board construction to resist board failure during use.

To achieve these and other advantages, in general, in one aspect, a transparent and buoyant aquatic recreation board is provided. The board includes an elongated buoyant body having front and rear ends and upper and lower surfaces extending between the front and rear ends. The body is constructed of a substantially transparent material. A support frame is disposed within the body and provides support to the body against collapsing. The support frame has a main spar extending between the front and the rear ends of the body, a first plurality of transverse spars extending laterally outward from a first longitudinal side of the main spar at spaced intervals, and a second plurality of transverse spars extending laterally outward from a second longitudinal side of the main spar at spaced intervals.

In general, in another aspect, the board may further include a fraction pad disposed on the upper surface. The traction pad being made of a substantially transparent material.

In general, in another aspect, the support frame may include a peripheral spar extending along the entire perimeter of the body that is connected to the main spar at the first and the rear ends, connected to each of the first plurality of transverse spars, and connected to each of the second plurality of transverse spars.

In general, in yet another aspect, the body may be a tightly sealed hollow body or may be solid throughout.

In general, in another aspect, the board further include a battery powered light having a switch operable to turn the light on and off. The light is disposed within the body towards the front end and positioned such that the light projects in a downwardly and outwardly direction from the bottom surface of the body to illuminate the water approximate the board. The switch is disposed on the top surface of the body in a manner that is accessible for operation by a user of the board.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
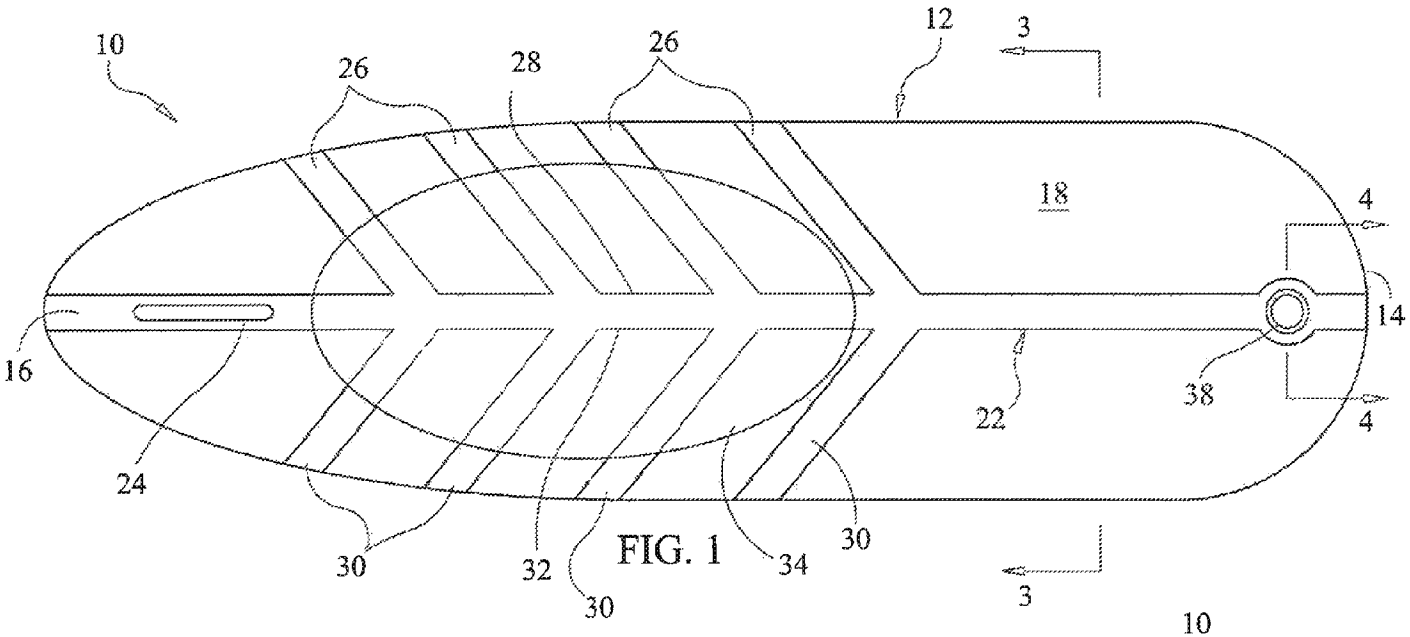
FIG. 1 is a top view of a transparent and buoyant aquatic recreation board constructed in accordance with the principles of an embodiment of the present invention.

With reference now to the drawings a new recreational water board, and particularly, a standup paddle board embodying the principles and concepts of an embodiment of the invention and generally designated by the reference numeral 10 will be described.

Figure 2:
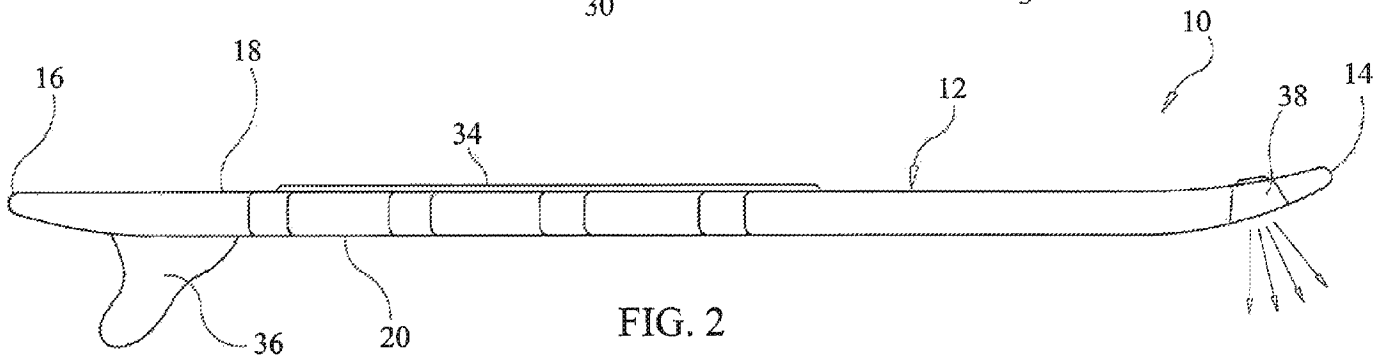
FIG. 2 is a side view of a transparent and buoyant aquatic recreation board constructed in accordance with the principles of an embodiment of the present invention.

Initially referring to FIGS. 1 and 2, the board 10 generally comprises an elongated body 12 that is configured to be buoyant and support a user upon the board as the board travels across the surface of a body of water. As illustrated, body 12 is generally configured in the shape of a standup paddle board. Body 12 has front and rear ends 14 and 16, and top and bottom surfaces 18 and 20 extending between the front and rear ends. Body 12 is substantially constructed of a transparent material, thus permitting viewing through the body from the top and bottom surfaces 18 and 20, and providing underwater viewing to the user of the board 10.

Body 12 may be constructed from various suitable, transparent materials including plastics and foam. For example, body 12 may be constructed of transparent supermicro-cellular polymer foams. U.S. Pat. No. 6,555,589 and U.S. Pat. No. 6,555,590 described supermicro-cellular polymer foams and method for their manufacture, and are incorporated herein in their entirety by reference. Body 12 may also be constructed from suitable plastics such as, but not limited to, Acrylic (polymethlamethacrylate), Butyrate (cellulose acetate butyrate), Lexan (polycarbonate), and PETG (glycol modified polyethylene terphthalate).

Figure 3A:
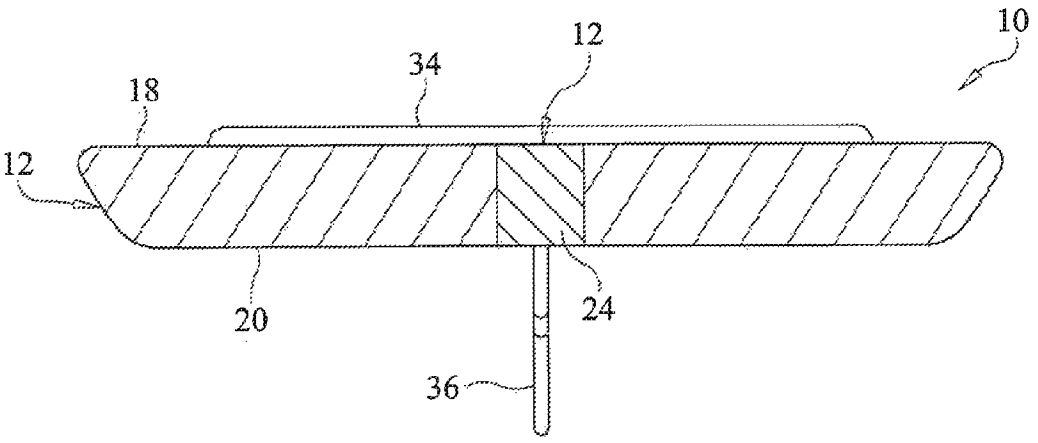
FIG. 3*a* is a cross-sectional view taken along line 3-3 in FIG. 1 and illustrated a solid body construction.
Figure 3B:
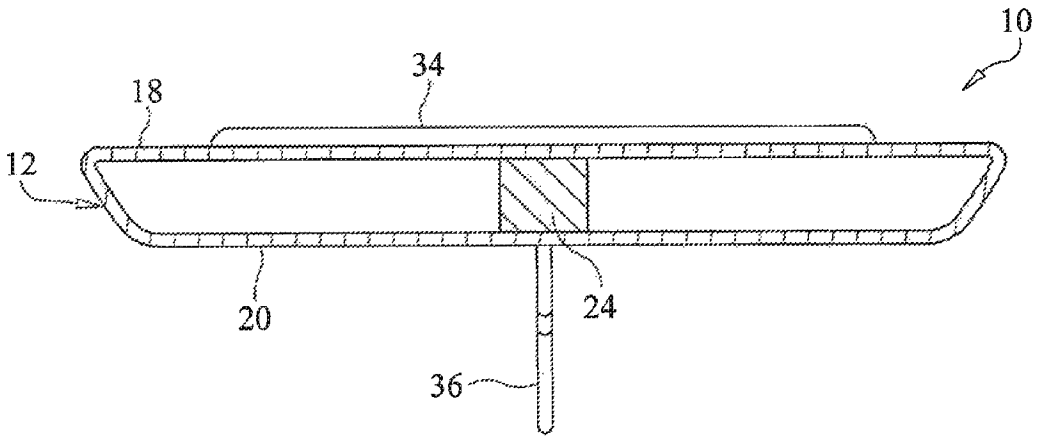
FIG. 3*b* is the cross-section of FIG. 3*a* illustrating an alternative, hollow body construction.

Body 12 may have a solid construction as shown in FIG. 3*a* or may also have a hollow-shell construction, shown in FIG. 3*b*. In the hollow-shell construction, the body 12 is tightly sealed against water entering and accumulating in the interior of the body.

Board 10 further includes a support frame 22 disposed within the body 12 that provides structural support to the body and prevents the body against collapsing or buckling. The support frame 22 has a main spar 24 extending between the front and rear ends 14 and 16, a first plurality of transverse spars 26 extending laterally outward from a first longitudinal side 28 of the main spar and at spaced intervals therealong, and a second plurality of transverse spars 30 extending laterally outward from a second longitudinal side 32 of said main spar at spaced intervals therealong. Spars 24, 26 and 30 vertically extend between the top and bottom surfaces 18 and 20 of body 12, and are illustrated as being flush with the top and bottom surfaces. It is contemplated, however, that spars 24, 26 and/or 30 may terminate at a vertical inwardly spaced distance from the top and bottom surfaces, respectively. In one embodiment, the support frame may be made of a substantially transparent material. In another embodiment, the main spar, the first and the second plurality of transverse spars may be made of a substantially transparent material and the peripheral spar may be opaquely colored to indicate the perimeter of the body.

Board 10 further includes a traction pad 34 secured to the top surface 18 of body 12 to provide grip to a user's body, and particularly, the user's feet to prevent slipping while standing on the board. The traction pad 34 is formed of a clear thermoplastic material so as to allow a user to see through the traction pad and not preclude the user's underwater view along the area to which the traction pad is secured to the body 12. U.S. Pat. No. 7,316,597 provides an example of a suitable transparent traction pad that may be utilized, and is incorporated in its entirety herein by reference.

Board 10 also includes a stabilizing fin 36 extending downwardly from the bottom surface 20 and towards the rear end 16 of the body. Stabilizing fin 36 may also be constructed of a transparent material.

Figure 4:
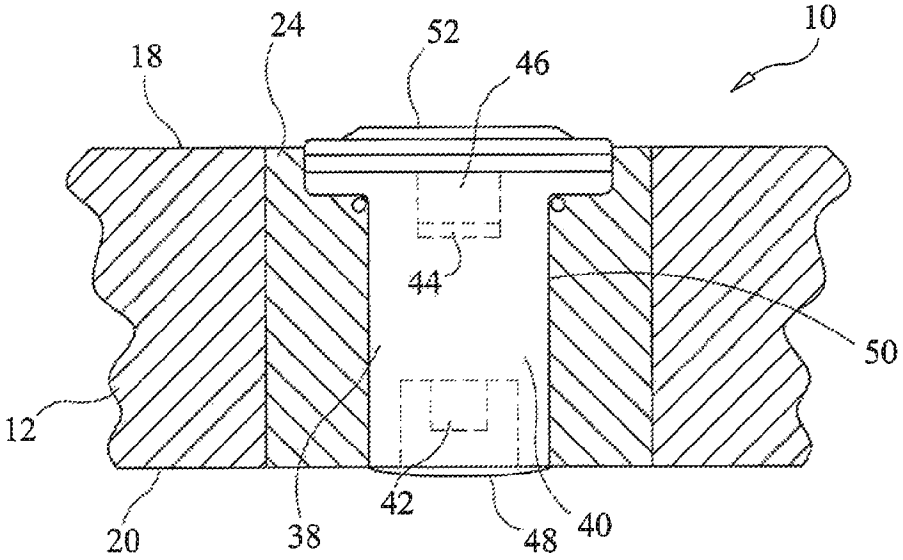
FIG. 4 is a cross-sectional view taken along line 4-4 in FIG. 1 and illustrates a battery operated light assembly to illuminate the water below the board when in use.

Board 10 may also include a battery powered underwater illuminating light or lamp 38 disposed within body 12 towards the front end 14 and configured to project light in a downwardly and outwardly direction from the bottom surface 20 of the body to illuminate the water forward and below the board 10. The particular construction of lamp 38 is not overly important, and should be constructed to be water-proof and to permit replacement of both the light emitting source and the battery. For example, FIG. 4 illustrates only one possible configuration of lamp 38, which includes a lamp housing 40 which contains the light emitting source 42, the battery 44 and an on/off switch 46. Lamp housing 40 may also be fitted with a lens 48 to provide desired directional control and/or focus of the projected light. In this exemplary lamp configuration, the lamp housing 40 may be inserted into a bore 50 vertically extending through the body and threadably or frictionally retained therein against withdrawal. As illustrated in FIG. 4, in one embodiment, the lamp housing 40 is flush with the bottom surface 20 of the body.

Regardless of the lamp configuration, it is desirable to operate the switch 46 from the top surface 18, such as, for example, by a user's foot to turn the light on or off while the board is in use. Accordingly, the switch 46 or a switch operator, such as rubber or elastomeric pad 52 is disposed on the top surface 18 of the body 12 to permit operation by a user while standing on the board.

Figure 5:
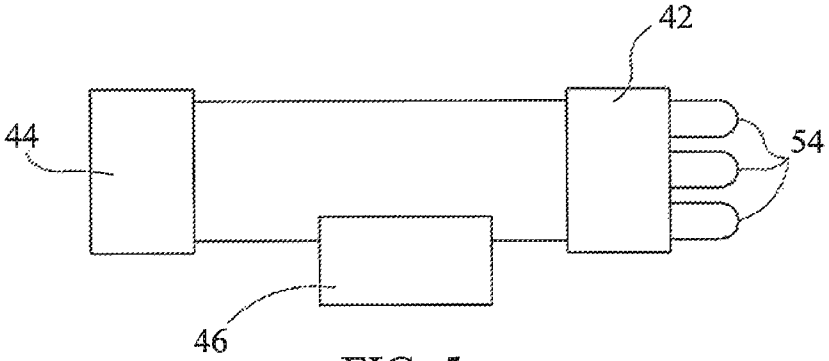
FIG. 5 is a block schematic of the light assembly of FIG. 4.

In FIG. 5 there is illustrated a simplified block diagram of the light emitting source 42, switch 46 and battery 44. In an embodiment, light emitting source 42 may include one or more LEDs 54. LEDs 54 may be configured to emit various colors of light as desired.

Figure 6:
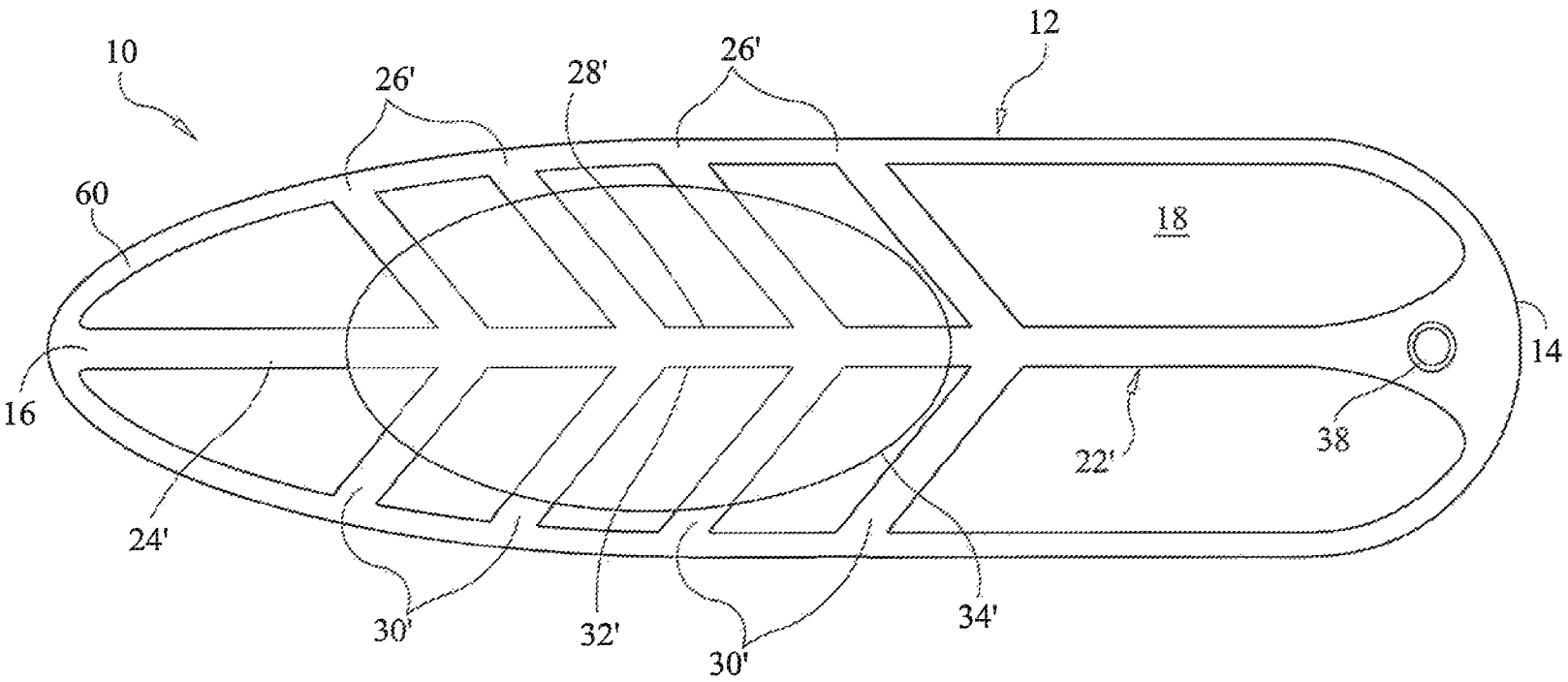
FIG. 6 is a top view of a transparent and buoyant aquatic recreation board constructed in accordance with the principles of an embodiment of the present invention having an alternative support frame construction that includes a peripheral spar.

With reference now to FIG. 6, there is illustrated board 10 with an alternative support frame 22' having a main spar 24' extending between the front and rear ends 14 and 16, a first plurality of transverse spars 26' extending laterally outward from a first longitudinal side 28' of the main spar and at spaced intervals therealong, a second plurality of transverse spars 30' extending laterally outward from a second longitudinal side 32' of said main spar at spaced intervals therealong, and a peripheral spar 60 extending along the entire perimeter of the body 12. The peripheral spar 60 is connected to the main spar

24' at ends 14 and 16, is connected to each of the first plurality of transverse spars 26', and is connected to each of the second plurality of transverse spars 30'. Spars 24', 26', 30' and 60 vertically extend between the top and bottom surfaces 18 and 20 of body 12, and are illustrated as being flush with the top and bottom surfaces. It is contemplated, however, that spars 24', 26', 30' or 60 may terminate at a vertical inwardly spaced distance from the top and bottom surfaces, respectively. Further it is contemplated that spar 60 or either of the other spars may be colored to indicate their location, and specifically spar 60 to indicate the edge of the body 12 and thus board 10.

A number of embodiments of the present invention have been described. Nevertheless, it will be understood that various modifications may be made without departing from the spirit and scope of the invention. Accordingly, other embodiments are within the scope of the following claims.

What is claimed is:

1. A transparent and buoyant aquatic recreation board, comprising:

an elongated buoyant body having front and rear ends and upper and lower surfaces extending between said front and rear ends, said body being made of a substantially transparent material;

a support frame disposed within said body and providing support to said body against collapsing, the support frame having a main spar extending between said front and said rear ends, a first plurality of transverse spars extending laterally outward from a first longitudinal side of said main spar at spaced intervals, a second plurality of transverse spars extending laterally outward from a second longitudinal side of said main spar at spaced intervals, and a peripheral spar extending along the entire perimeter of said body, said peripheral spar connected to said main spar at said front and said rear ends, connected to each of said first plurality of transverse spars, and connected to each of said second plurality of transverse spars, wherein said main spar and said first and second plurality of transverse spars are made of a substantially transparent material and said peripheral sear is opaquely colored to indicate said perimeter of said body;

a battery powered light disposed in a housing within said body towards said front end and positioned such that the housing is embedded in the main spar and flush with the lower surface of the body; and a lens fitted on the housing to direct said light in a downwardly and outwardly direction from said lower surface of said body to illuminate water forward and below the board.

2. The board of claim 1, wherein said body is a tightly sealed hollow body.

3. The board of claim 1, wherein said body is solid throughout.

4. The board of claim 1, wherein said battery powered light includes a switch operable to turn the light on and off; and wherein said switch is disposed on said upper surface of said body in a manner that is accessible for operation by a user of the board.

* * * * *